United States Patent [19]

Lenglet et al.

[11] 4,383,423

[45] May 17, 1983

[54] THERMAL SEPARATORS EMPLOYING A MOVABLE DISTRIBUTOR

[75] Inventors: Eric L. H. Lenglet, Marly-le-Roi; Phillippe A. H. Marchal, Plaisir, both of France

[73] Assignee: Nouvelles Applications Technologiques, Rueil-Malmaison, France

[21] Appl. No.: 247,735

[22] Filed: Mar. 26, 1981

[30] Foreign Application Priority Data

Apr. 2, 1980 [FR] France ..... 80 07472

[51] Int. Cl.[3] ..... F25B 23/00

[52] U.S. Cl. ..... 62/467 R; 137/625.11; 138/45; 138/46

[58] Field of Search ..... 62/467, 511, 527, 5; 138/44, 45, 46; 137/625.11

[56] References Cited

U.S. PATENT DOCUMENTS

| | | | |
|---|---|---|---|
| 2,825,204 | 3/1958 | Kadosch et al. | 60/35.6 |
| 3,146,798 | 9/1964 | Chenault | 138/45 |
| 3,182,686 | 5/1965 | Zilberfarb | 138/45 |
| 3,314,244 | 4/1967 | Green | 62/88 |
| 3,541,801 | 11/1970 | Marchal et al. | 62/5 |
| 3,653,225 | 4/1972 | Marchal et al. | 62/467 |
| 3,828,574 | 8/1974 | Boy-Marcotte et al. | 62/467 |
| 3,992,898 | 11/1976 | Duell et al. | 138/45 |

*Primary Examiner*—Ronald C. Capossela
*Attorney, Agent, or Firm*—Wigman & Cohen

[57] ABSTRACT

A thermal separator is provided using a mechanical distributor which is suitable for transforming a continuous supply of gas under pressure originating from a suitable source into a pulsed gas flow, in order to place under pulsatory operating conditions one or several operational receiving tubes connected to this distributor, the relative geometrical arrangement of the source, distributor and receiving tubes being such that the gas under pressure passes, during its passage through the distributor, in a direction which extends from the outside towards the inside of the distributor.

7 Claims, 19 Drawing Figures

THERMAL SEPARATORS EMPLOYING A MOVABLE DISTRIBUTOR

BACKGROUND OF THE INVENTION

Thermal separators are pieces of apparatus which operate on pulsed gas flows and take advantage of the physical phenomena which result from this in order to subdivide an initial compressed gas flow at a certain temperature into a first flow of lower temperature and a second flow of higher temperature, the latter flow possibly being low or zero, so that the systems behave in effect like gas-cooling apparatuses. Apparatuses of this type are well known to those working in this field and reference could be made, in this respect, to Marchal et al., U.S. Pat. No. 3,541,801, Marchal et al., U.S. Pat. No. 3,653,225 and Boy-Marcotte et al., U.S. Pat. No. 3,828,574, which describe various embodiments of such apparatuses in which the pulsed flows in question are obtained starting from a continuous supply of gas, using an injector-distributor which may either be static and in this case include a fluid bistable, or be movable in rotation or linear motion and in this case include a type of rotating plug body or sliding valve, depending on the case.

The present invention is directed more in particular to apparatuses of this last type, in other words of the type using a movable injector-distributor, which are particularly, although not exclusively, adapted to treat small gas flows.

In thermal separators which are known at present, which operate using a rotary injector and usually run under conditions of appreciable flow, the gas under high pressure is injected radially, from the center towards the periphery, into a bundle of receiving tubes which are arranged to radiate on a crown formation or are mounted in a star configuration.

If it is desired to provide a scaled-down apparatus for operating under low flow conditions, the injector will be small and consequently the leakage from the injector will be correct, but the receiver tubes will of necessity have a very small diameter, which is a difficult thing to provide in practice and has a harmful effect on the yield (as a result of fluid friction) unless it is rotating fast. Moreover, the permanent leakage at the point of entry to the rotating injector is appreciable.

Moreover, it is difficult, for reasons of geometry, to connect together two diametrically opposing tubes on the crown, into one single one, for increasing the diameter of them in the working region.

If, furthermore, only several large tubes are placed on the crown, the leakage will increase (since the injector must then be larger) and it is necessary to operate at very high speeds of rotation, in order to operate correctly.

It will thus be seen that the thermal separators of the rotary type at present in use are barely suitable for the treatment of small flows where the requirements: correct speed of opening, use of tubes which are not too small and, above all, negligible leakage, are more difficult to achieve.

SUMMARY OF THE INVENTION

The present invention provides a thermal separator having a movable distributor which makes it possible to meet all these requirements, even when operating under conditions of low gas flows, by employing an arrangement which characterises the invention consisting in inverting the senses of propagation of the fluid: the gas under high pressure still enters radially (or at a small angle), but in a direction extending from the outside towards the inside of the apparatus, which makes it possible to join together, in a very easy manner, several receiving channels to form one single channel. Between the rotating part (where the receiving channels become united) and the remainder of the receiving tubes which are fixed (after the uniting of several channels), leakage does still exist (as is the case with the injector in apparatuses presently used), but it is negligible during the periods when the receiving tube is discharging (approximately 70% of the time). Furthermore, as the entry to each individual channel may be a rectangular slot (which is easy to provide), rapid "opening" into fairly wide receiving tubes (at the union of several individual tubes) is achieved, with only moderate leakage.

BRIEF DESCRIPTION OF THE DRAWINGS

The description which follows in conjunction with the attached drawings, which is provided solely by way of non-limiting example, will lead to a clear understanding of how the invention can be provided in practice.

DETAILED DESCRIPTION OF EMBODIMENTS

Figure 4:
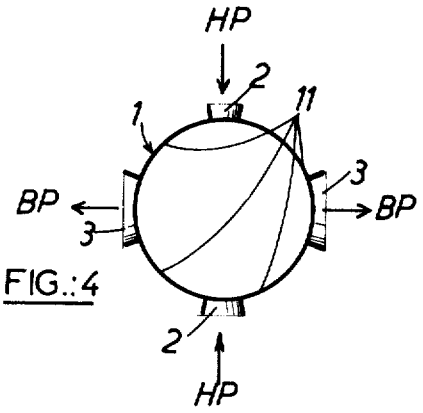
FIGS. 3, 4 and 4A show the corresponding designs of the cylindrical casing in which the plug body rotates, these views being respectively axial and transverse sections of the casing.
Figure 1:
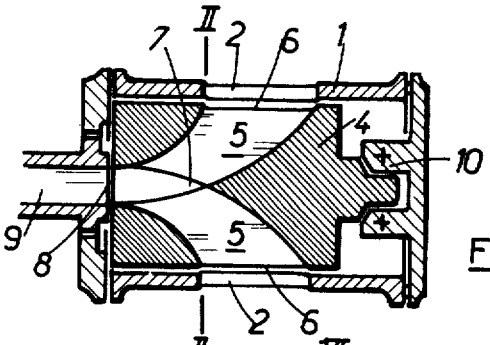
FIGS. 1, 1A, 1B and 1C are axial sectional views of various embodiments of the thermal separator fitted with a distributor employing a rotary plug body, according to the present invention.

In the embodiment shown in FIGS. 1 to 4, the fixed casing 1 of the apparatus is a hollow cylinder which includes two opposing rectangular ports 2,2 providing an opening for the high pressure gas HP and two opposing rectangular ports 3,3 providing an opening for the expanded gas BP, situated on the same straight line as the above but offset by 90% with respect to them. Inside this fixed cylinder 1, a cylindrical plug body 4 rotates essentially is solid, and has two individual channels 5,5 formed in it which start at its periphery by a thin longitudinal rectangular slot 6,6 and become joined together at the center in order to form a square 7. This joining then develops along the longitudinal axis by a transformation from a square shape to a round shape and the terminal circular section 8 rotates at a position just facing a large receiving tube 9 which is coaxial with section 8 and of the same cross section. The apparatus which has just been described operates in the following manner:

When the plug body 4 rotates, it being supported by an adequate bearing arrangement which is shown diagrammatically at 10 in FIG. 1, the peripheral slot 6,6 of the individual channels 5,5 pass successively in front of the ports HP2,2 and BP3,3, with intermediate periods of closing off corresponding to the solid sections 11 of the wall of the casing 1 extending between the ports. The result of this is an alternation of pressure at the common discharge point 8 of the individual channels 5,5 so that the receiving tube 9 becomes the seat of a pulsating gas flow thus bringing about the known phenomena inherent in apparatuses of this type which have been the object of the three U.S. Patents referred to above.

It will however be noticed that, in contra-distinction to the above, in the apparatus according to the present invention, the general direction of the gas under high pressure is from the outside (at 6) towards the inside (at 7-8). Since the supply phases are limited to the times at which the slots 6,6 dwell, during their rotary movement, at a position facing the ports HP2,2—while the major portion of one revolution, in the region of 70%, corresponds to the passage of the slots 6,6 over the circumferential extent of the ports BP3,3 and the solid sections 11—this reduces, to the same extent, the duration and consequently the size of the gas leakage which can be produced in positions where operating play exists between the central discharge 8 of the individual channels 5,5 and the adjacent end of the receiving tube 9, leakage being negligible during the periods when the receiving tube 9 is not being supplied.

Furthermore, the peripheral slots 6,6 as they are longitudinal and thin, only lead to the occurrence of extremely brief "laminating" transitions which, in truth, are insignificant between the position of complete closing off (slots 6 facing the solid sections 11 of the wall of the casing 1) and complete opening to a position of full cross-section (slots 6 facing the ports 2 or 3), when the plug body 4 is rotating, without it being necessary to provide for rotation at high speeds.

Figure 6:
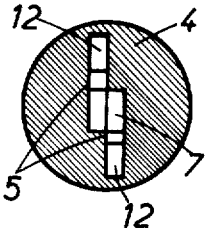
FIGS. 5 and 6 are analogous views to FIGS. 1 and 2 respectively, which show a differing embodiment of the invention, FIG. 6 being a view along line VI—VI in FIG. 5.
Figure 5:
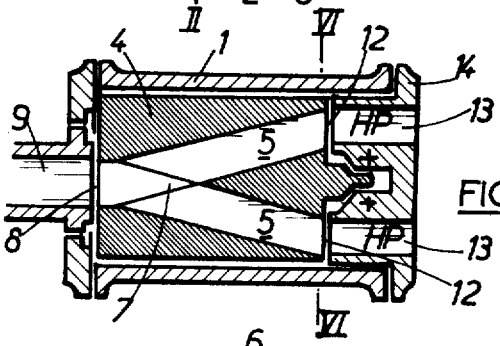

The embodiment shown in FIGS. 5 and 6 essentially differs from the preceding embodiments as a result of the fact that the plug body 4 includes individual channels 5,5 which start at orifices 12,12 which are oriented parallel to the longitudinal axis and then passed in the direction of the ports HP13,13 and BP (not shown) which are also arranged axially and distributed along a circle on the base 14 of the casing 1.

In the two embodiments above, use has been made of one single receiving tube 9 which corresponds to the meeting 7-8 of the two individual channels 5,5. But it is obvious that these numbers are in no way imperative and that one could, for example, employ two receiving tubes in place of one single one and/or four elementary channels per receiving tube instead of two.

Figure 3:
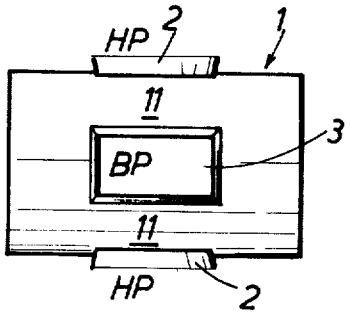
Figure 2:
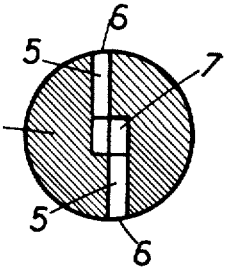
FIG. 2 shows the plug body itself, in transverse section according to line II—II in FIG. 1.
Figure 8:
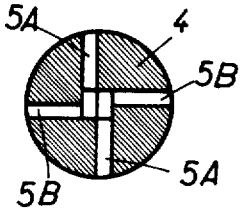
FIGS. 7 and 8, on the one hand, and FIGS. 9 and 10 on the other, are diagrammatical views in axial section and transverse section of two further differing embodiments, only the rotary plug body being shown.
Figure 7:
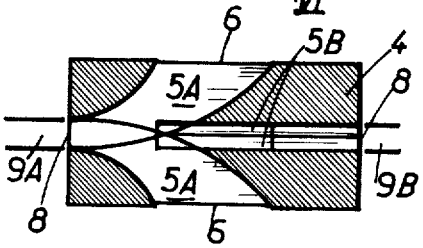

Thus, in the embodiment shown in FIGS. 7 and 8 (where the pairs of ports HP and ports BP of the fixed casing 1 shown in FIGS. 3 and 4 have been maintained, but not shown in these Figures), recourse has been made to four channels arranged pairwise in a staggered arrangement: on the one hand, the channels 5A, 5A discharge into a receiving tube 9A and, on the other hand, channels 5B,5B discharge into a further receiving tube 9B.

Figure 10:
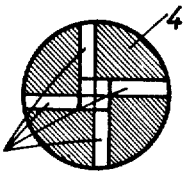
Figure 9:
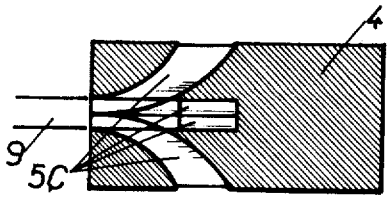

In the variant in FIGS. 9 and 10 which correspond to the provision of four ports HP and four ports BP which alternate on the wall of the fixed cylindrical casing, the rotatable plug body 4 carries four individual channels 5C which are at 90° with respect to each other, and all four of them become joined together in order to discharge into the same receiving tube 9.

One could just as well provide the rotatable plug body 4 with eight basic channels which are sub-divided into two groups of four, each one of these two groups becoming joined in order to discharge into their own receiving tube.

It would also be possible to replace the plug body 4, which in the embodiments described is essentially solid, by a hollow rotatable cylinder, each individual channel such as that shown at 5 being reduced to a port which is formed so as to pass through the wall of the hollow cylinder.

Further variants can moreover be envisaged, if it is desired to perfect the balancing of the rotatable part by, in particular, relieving it of alternating axial forces of aeordynamic origin essentially arising from the deviation which the fluid flows must inevitably undergo when passing through the plug body 4 as a result of the different orientations of the ends 6 and 8 of the individual channels 5. In order to achieve this, all that is necessary is to arrange for each individual channel 5, which impresses a deviation in one sense upon the flow, to correspond to a second channel which has an inverse orientation such as to impress upon the flow a deviation which is in the opposite sense to the first. In this way, the aerodynamic reactions caused by the doubling-up of the channels mutually cancel each other out at each particular instant, provided, obviously, that provision is made for simultaneous operation of them (feed, closing off, discharge).

Figure 11:
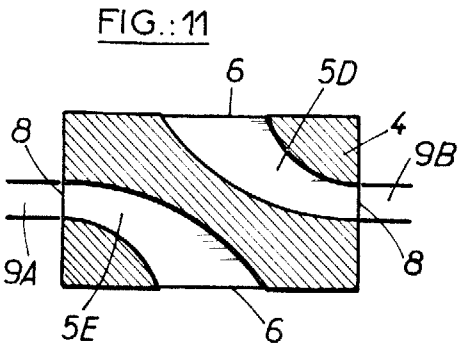
FIG. 11 is an axial section through an improved plug body which is designed to take advantage of axial aerodynamic balancing.

This is actually the case in the embodiment which is illustrated in FIG. 11 where, in this case as well, only the rotatable plug body 4 is shown, the fixed casing (which is not shown) still being the same one as was shown in FIGS. 3 and 4. The cross-sectional view shown in FIG. 1 shows two paired individual channels 5D,5E which originate from peripheral slots 6,6 which are diametrically opposite and discharge through axial openings 8,8 at the opposing ends of the plug body 4, into receiving tubes 9A, 9B such as those shown in FIG. 7. It can be clearly seen in FIG. 11 that the individual channels 5D, 5E have inverse curvatures.

Figure 12:
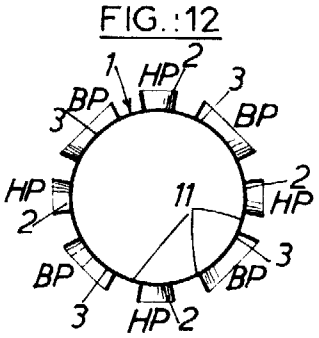
FIG. 12 is an analogous view to that in FIG. 4, of a variant of the fixed cylindrical casing.

In this same line of thinking, one could wholly envision the plug body 4 shown in FIG. 7, and provide for it to rotate in a fixed casing 1 such as the one shown in FIG. 12 which has four ports HP2 at 90° with respect to each other and, in the same way, four ports BP3 which are also at 90° with respect to each other but which are offset by, for example, 45° with respect to the first, so as to subject the doubled-up individual channels 5 to simultaneous supply operations at high pressure, HP, at 2, of discharge, BP, at 3 and of intermediate closing off at 11.

One would moreover not depart from the scope of the present invention by replacing the distributor using a rotatable plug body 4 with a distributor employing a slide valve, as will be described below by taking two examples of embodiments.

Figure 13:
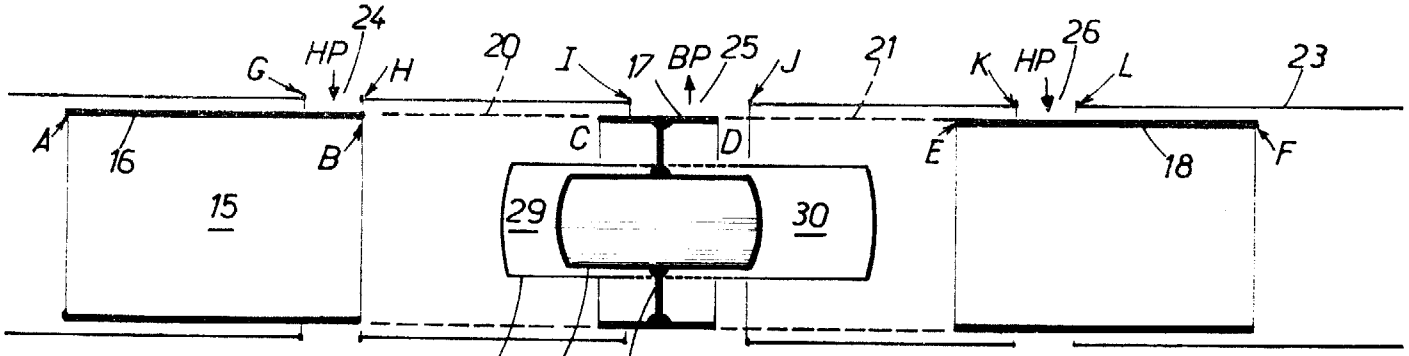
FIG. 13 is a diagrammatic view in axial section of a thermal separator equipped with a distributor employing a slide valve according to the present invention.
Figure 14:
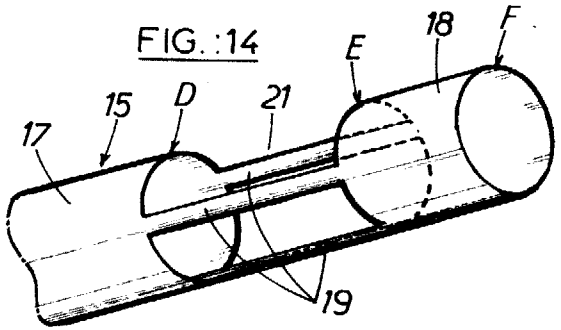
FIG. 14 is a simplified partial view in perspective of the slide valve.

In the example of an embodiment shown in FIGS. 13 and 14, the slide valve 15 is made up by a thin-walled tube which has extensive cut-out portions at two intermediate regions which separate three continuous tubular sections: a first end section 16 extends between the ends A and B, a mid-section 17 extends between the ends C and D and a second end section 18 extends between the ends E and F. The successive tubular end sections 16-17-18 are connected together by longitudinal connecting rods 19 which, firstly, rigidly attach the end sections 16-17-18 together in order to provide the slide valve 15 in the form of a one-piece construction in the form of a hollow cylinder provided with passages and which, secondly, provide in the part between them extensive cut-out portions 20 and 21 which extend, respectively, between the ends B-C and the ends D-E. A transverse partition 22 is fixed inside the tubular mid-section 17 and the purpose of this partition 22 and details of it will be given in what follows.

The slide valve 15 designed in this way slides in a fixed sleeve 23 which has connected to it one or several pulsatory receiving tubes (which are not shown in the drawing, but which may be located in the extension of the sleeve 23 at one side of it or both). Ports are formed in the wall of this fixed sleeve 23 at three regions which are distributed along its longitudinal axis: a first set of lateral ports 24 for entry of gas at high pressure HP extend axially between the edges G and H; a set of middle ports 25 for exit of the gas at low pressure BP extend axially between the edges I and J; a second set of lateral ports 26 for entry of gas at high pressure HP extend axially between the edges K and L.

The dimensions, measured along the longitudinal and axis of the different constructional parts, some being solid and some having passages, of the wall of the fixed sleeve 23 on the one hand, and of the sliding valve 15 on the other, are mutually determined in such a way that, at the time of relative reciprocating movement of these two components, the following opening and shutting operations of the respective passages are able to occur:

The slide valve 15 being, at a given moment, in the position shown in FIG. 13, it will now be supposed that it becomes displaced in the fixed sleeve 23 towards the left in the drawing. The point B on the slide valve 15 will uncover the entry ports HP24 as soon as it passes beyond the point H on the fixed sleeve 23. It will then apply to the partition 22 of the sliding valve 15 a force which is contrary to this movement: in effect, to the righthand side of the partition 22, low pressure prevails since the righthand portion of the slide valve 15 is discharging (with the outlet ports BP25 open); consequently, to the right of the partition 22, the low pressure BP prevails and to the left, the high pressure HP prevails. The slide valve 15, in its displacement towards the left, will consequently be subject to a braking action; it then stops, and then sets off again in the opposite direction. The ports HP24 become closed off, the gas to the left of partition 22 becomes expanded and escapes through the outlet ports BP25 as soon as the point C on the slide valve 15 passes beyond the point Iin the sleeve 23; while the point E on the second of these parts HP26 now passes beyond the point K on the second of these, the righthand portion of the slide valve 15 is now in communication with the input parts HP26. The inverse phenomenom now takes place: first braking of the movement towards the right of the slide valve 15, followed by stopping and re-starting in the opposite direction, in other words towards the left, and so on.

It will thus be seen that the to-and-fro movement of the sliding valve 15 in the fixed sleeve 23 carries on automatically and indefinitely. However, a more detailed analysis of this motion reveals the fact that this movement is not stable: the amplitude carries on increasing with each stroke.

In order to ensure that there is stability of its movement, the slide valve 15 has been provided with a pneumatic spring which, in the embodiment shown in FIG. 13, is made up by a piston 27 which is rigidly fixed to the partition 22 and is movable in a cylinder 28, the opposing faces of the piston 27 defining, together with the facing base portions of the cylinder 28, two sealed compartments 29-30 of variable volume in the inverse sense: when the slide valve 15 becomes displaced towards the left in the drawing—and as a result of this the piston 27 as well since it constitutes an integral part of slide valve 15—the gas filling the compartment 29 becomes compressed while the gas filling the compartment 30 becomes expanded. The result is that a pressure difference is set up at both sides of the piston 27 having a resultant which is directed towards the right and consequently counteracts movement towards the left of the slide valve 15. The reverse phenomena occur when the slide valve 15 becomes displaced towards the right carrying with it the piston 27: gas in the compartment 29 becomes expanded while gas in the compartment 30 becomes compressed, thus reversing the direction of the resultant force applied on the piston 27.

For a detailed description concerning the design and operation of pneumatic springs, reference should be made to Allinquant et al., U.S. Pat. No. 4,089,512.

Figure 15:
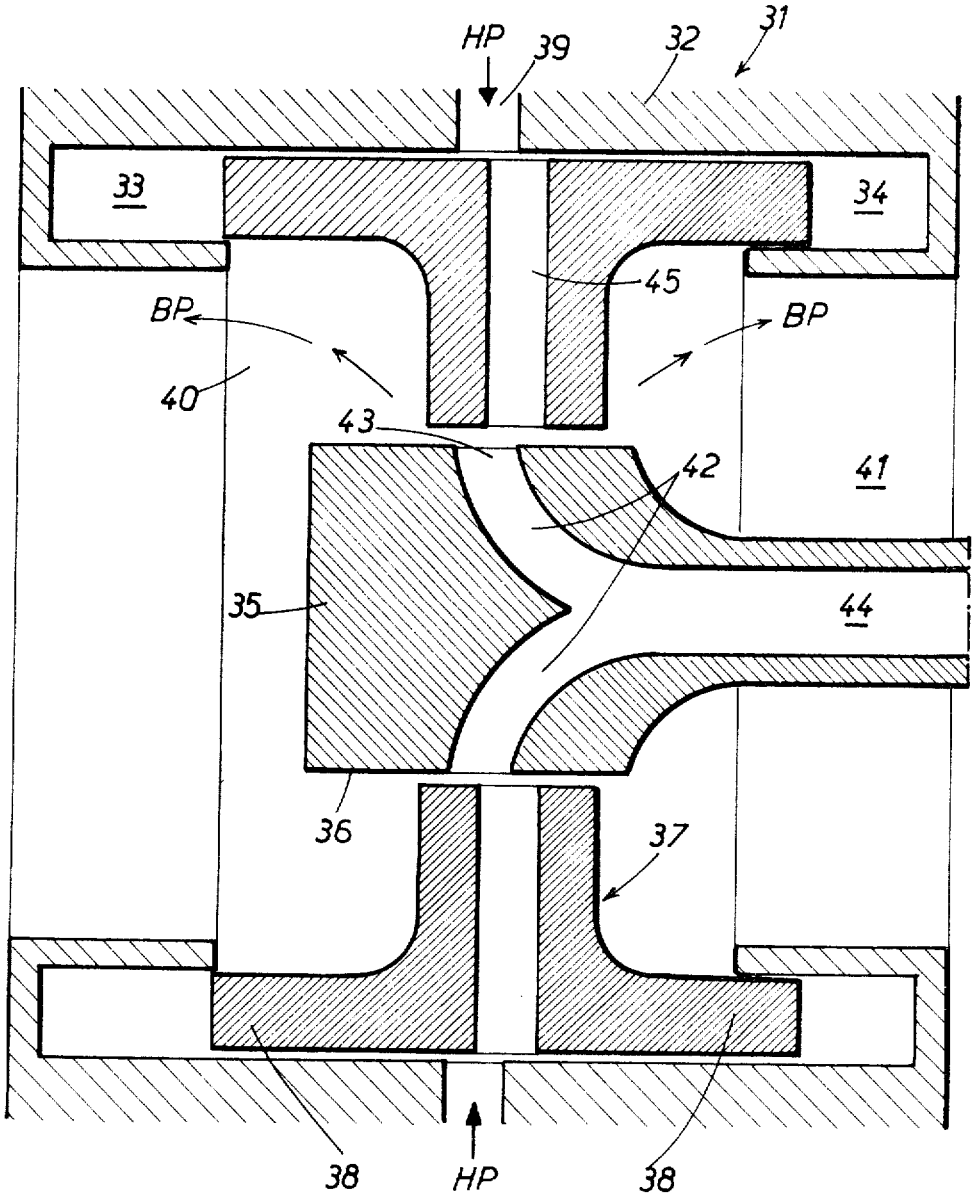
FIG. 15 is an axial section view which is analogous to that shown in FIG. 13 and shows a variant of the thermal separator using a slide valve.

An alternative embodiment of an apparatus employing a sliding valve is shown in FIG. 15 and is made up by two bodies which can be moved linearly with respect to each other, these being:

Firstly, a fixed body 31 having a peripheral component 32 in the form of a casing with a cylindrical wall the ends of which are folded over through 180° towards the inside in order to constitute two annular end compartments 33 and 34, the fixed body 31 moreover having an integral central portion 35 which has an outer cylindrical surface 36;

Secondly, a sliding body 37 which is guided in a sealed manner along the cylindrical surfaces 36, this sliding body 37 having opposing annular projections 38 which constitute a double-faced piston that cooperates with the annular end compartments 33 and 34.

The peripheral component 32 of the fixed body 31 includes, in its transverse mid-portion, ports 39 for entry of gas at high pressure HP and, at its center, on both sides of the sliding body 37, a first opening 40 for outlet of expanded gas BP and a second opening 41 for outlet of expanded gas BP. In its turn, the central portion 35 of this fixed body 31 is hollowed out and carries channels 42 which discharge at orifices 43 situated on the same straight line as the inlet ports HP39 and which jointly terminate in a common channel 44, which itself may be a pulsatory separator tube or may be connected to such a tube.

The sliding body 37, as far as it is concerned, includes radial channels 45 which are able, in one position (the position which has been illustrated in FIG. 15), to put the channels 42 in communication with the inlet ports HP39 and, in a further position which is spaced from the position just described, either to one side or the other, are able to connect these channels 42 to a discharge either through the outlet BP40 (when the sliding body 37 is moved to the right), or through the outlet BP41, (when the sliding body 37 is moved to the left).

This embodiment in FIG. 15 closely resembles in its essence the embodiment described above in FIGS. 11-14: the sliding body 37 moves in an alternating motion (like the slide valve 15 in the previous embodiment), identical action provided by the pneumatic spring made up by the cooperation of the double-faced piston 38 with the annular end compartments 33 and 34 (like the respective components 27-29-30 of the preceding embodiment). There is clearly no point in repeating the explanations already given with reference to that embodiment in FIGS. 11-14.

It should nevertheless be noted that the driving action of the slide body 37 results from a mode of operation which is actually slightly different: the energizing force providing for the alternating movement of the slide body 37 results from the fact that, when the latter comes close to one end of its travel and connects the tube common channel 44 to discharge through opening 40 or 41, depending on the case, the low pressure gas BP which leaves the orifices 43 must "do an about turn" in order to escape, which sets up an urging action in the sense of the movement occurring since the gaseous flow strikes the corresponding face of the slide body 37 and is deflected by the latter towards the opening 40 or 41.

Figure 1A:
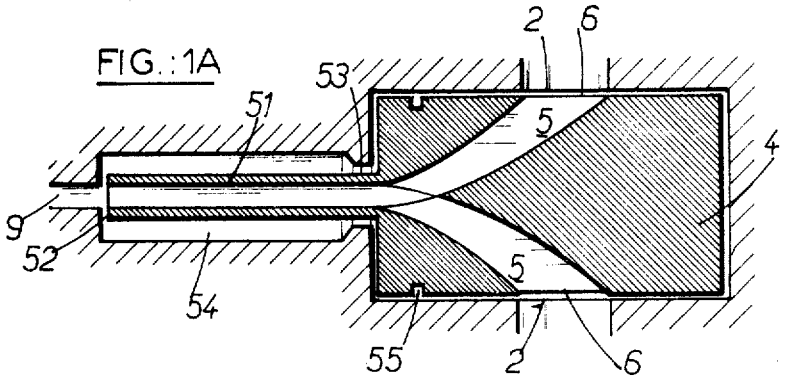

If one now refers back to the first embodiment described employing a rotary plug body 4, it was indicated above, that, although this is very small, there does nevertheless exist a leakage of gas between the central discharge 8 of the individual channels 5,5 and the adjacent end of the receiving tube 9 (see in particular FIG. 1). One could very well eliminate, or practically eliminate, any leakage at this point, by using a simple arrangement which is shown in FIG. 1A:

The operating play causing the leakage concerned is moved to a sufficient degree away from the rotary plug body 4, by using a tube extension 51 which is rigidly fixed to the body 4, so that the operating play 52 is located at a point where the expanding gas does not reach. The region of play 52 only occurs consequently where surrounding gas forming a buffer is present, the vectorial gas not reaching this point. In this case, the pseudo-leakage takes place within this region of surrounding gas, without disturbing the vectorial gas.

In fact, the leakage is encountered again at neck 53 but, in view of the buffering volume held in the area 54 surrounding the tube extension 51, the pressure in the latter is uniform and very close to the outlet pressure of the gas. Strictly speaking, the leakage will be negligible. It can moreover be counteracted by providing at the periphery of rotary plug body 4, a groove 55 which is supplied by the lateral leakages coming from the high pressure feed and originating from the ports 2 via a passage around the rotary plug body 4.

It will moreover be obvious that the embodiments which have been described are only examples and one could modify them notably by carrying out substitution using equivalent technical means, without this leading to departure from the scope of the invention.

Figure 1B:
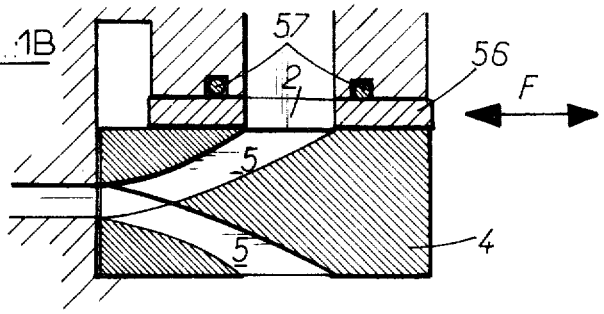
Figure 1C:
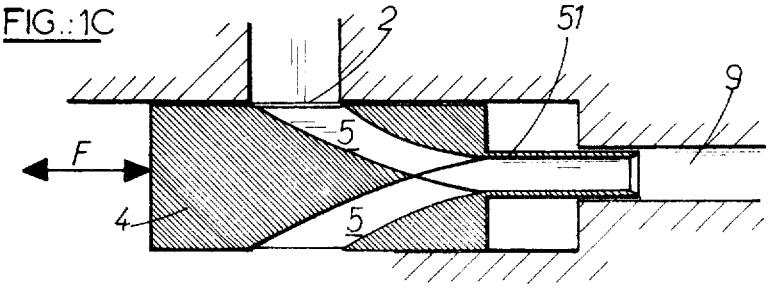

Thus, for example, one could provide two types of regulation for the flow:

Firstly, one could bring about relative axial linear motion in the direction of arrows F in FIGS. 1B and 1C, either of the injector system having the ports 2 with respect to the rotary plug body 4 (FIG. 1B), or doing just the opposite (FIG. 1C). In the first case, all that is needed is to provide the ports 2 on a sliding sleeve 56 which is guided in its axial translatory movement by roller bearings 57. In the second case, the rotary plug body 4 is arranged so it can be slid in the axial direction.

In both these cases, the opening time always remains at the same value, but the effective length of the injection port 2 is reduced.

Figure 4A:
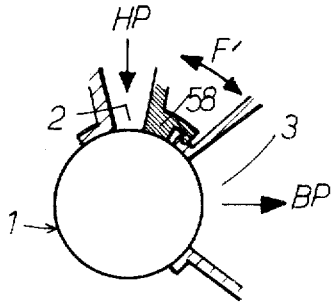

Secondly, in a variant which is illustrated in FIG. 4A which is a partial view, in transverse section, of the fixed casing or stator 1, a piece of diaphragm 58 is provided and is adapted to be able to be subject to a certain amount of angular displacement in the direction of arrows F'. By adjusting the angular position of this diaphragm 58, it is possible to regulate the effective width of the injection ports 2HP, which in effect provides for control of the time of supply of the gas under high pressure.

The applications to which the present invention can be put are quite numerous and varied and one could list those which would appear to be the most interesting and useful:

(a) Applications concerning the cooling of gases:

purification of waste gases (factories, ammonia plant, methanol plant, etc.);

liquefactions of helium and other gases at very low temperature;

(b) Applications of the hot receiving tube as an oven (use of the heat):

high temperature furnaces (plasmas) for the synthesis of chemical products (acetylene), CO, NO, hydrazine, cyanogen, nitrides, carbides, halogenated compounds, cyanide, halogenation reactions, oxydation reactions, reduction reactions of metal oxide and minerals in oxide form, decomposition of minerals in oxide form and mixed oxides);

thermal treatment furnaces (annealing, surface hardening)

furnaces used in steel making and foundries, the glass and ceramic industries, the food industries;

use as a plasma; generator in a blower using plasma applications to shock tubes;

ovens for heating hydrogen (pyrolysis of gas-oil) or of water vapor (steam-cracking, preheating of water vapor for producing hydrogen)

furnaces which make it possible to weld a tube in a noble metal into another tube (in applications involving protection against corrosion and abrasion).

The foregoing preferred embodiments are considered as illustrative only. Numerous other modifications and changes will readily occur to those skilled in the pertinent technology.

We claim:

1. A thermal separator comprising:

an upstream-located continuous pressure gas supply, at least one downstream-located pulse tube designed to work under gaseous pulsatory running conditions when fed with gas from the upstream-located continuous pressure gas supply, a mechanical distributor interposed between said upstream-located continuous pressure gas supply and said downstream-located pulse tube, said mechanical distributor including movable material having means having peripherally-located input means connected to said upstream-located continuous pressure gas supply, centrally-located output means connected to said downstream-located pulse tube, and intermediate duct means connecting said peripherally-located input means with said centrally located output means, whereby the pressure gas progresses through said mechanical distributor in a direction from the outside towards the inside thereof in travelling from said peripherally-located input means through said intermediate duct means up to said centrally-located output means to issue therefrom into said downstream located pulse tube.

2. Mechanical distributor as recited in claim 1, further comprising:

a stationary outer casing extending around said movable material valving means and having localized port means formed therethrough for periodic registration with said peripherally-located input means, at least one of said port means and said input means being of a size which is reduced in the direction of relative movement of said valving means, whereby, upon said relative movement, full registration of said port means and said input means for fluid flow therethrough and full nonregistration thereof for obturation occur almost instantaneously.

3. Mechanical distributor as recited in claim 2, wherein said at least one of said localized port means and said input means is in the form of a long and narrow rectangular slot, the narrowness of which lies in the direction of relative movement of said valving means.

4. Mechanical distributor as recited in claim 1, wherein said movable material valving means is a rotary valve plug.

5. Mechanical distributor as recited in claim 1, wherein said movable material valving means is a rectilinearly reciprocating slide valve.

6. Mechanical distributor as recited in claim 5, further comprising:

spring means for effecting the reciprocation of said slide valve.

7. Mechanical distributor as recited in claim 6, wherein said spring means is a gas.

* * * * *